US008453618B2

(12) United States Patent
Scharp

(10) Patent No.: US 8,453,618 B2
(45) Date of Patent: Jun. 4, 2013

(54) MULTI-PART PISTON FOR AN INTERNAL COMBUSTION ENGINE

(75) Inventor: Rainer Scharp, Vaihingen (DE)

(73) Assignee: MAHLE International GmbH, Stuttgart (DE)

( * ) Notice: Subject to any disclaimer, the term of this patent is extended or adjusted under 35 U.S.C. 154(b) by 0 days.

(21) Appl. No.: 13/325,319

(22) Filed: Dec. 14, 2011

(65) Prior Publication Data

US 2012/0080005 A1 Apr. 5, 2012

Related U.S. Application Data

(62) Division of application No. 12/381,838, filed on Mar. 17, 2009, now Pat. No. 8,127,738.

(30) Foreign Application Priority Data

Nov. 5, 2008 (DE) ..... 10 2008 055 909

(51) Int. Cl.
*F02F 3/00* (2006.01)
*F02F 3/22* (2006.01)

(52) U.S. Cl.
USPC ..... 123/193.6

(58) Field of Classification Search
USPC ..... 92/216, 219, 222, 231, 255, 256, 92/258; 123/193.6, 41; 29/888.042, 888.044
See application file for complete search history.

(56) References Cited

U.S. PATENT DOCUMENTS

| | | | | |
|---|---|---|---|---|
| 6,453,797 | B1 | 9/2002 | Bauer | |
| 6,557,514 | B1 | 5/2003 | Gaiser | |
| 7,934,482 | B2 | 5/2011 | Messmer | |
| 7,946,268 | B2 | 5/2011 | Messmer | |
| 8,127,738 | B2 * | 3/2012 | Scharp | 123/193.6 |
| 2003/0051694 | A1 | 3/2003 | Gaiser et al. | |
| 2007/0079775 | A1 | 4/2007 | Lin et al. | |
| 2007/0137605 | A1 | 6/2007 | Scharp | |
| 2007/0289568 | A1 | 12/2007 | Scharp et al. | |
| 2008/0011262 | A1 | 1/2008 | Scharp et al. | |
| 2009/0007880 | A1 | 1/2009 | Messmer | |
| 2009/0139481 | A1 | 6/2009 | Messmer | |
| 2009/0159037 | A1 | 6/2009 | Messmer | |
| 2009/0260593 | A1 | 10/2009 | Messmer | |
| 2009/0288618 | A1 * | 11/2009 | Issler et al. | 123/41.35 |

FOREIGN PATENT DOCUMENTS

| | | |
|---|---|---|
| EP | 1 222 364 | 7/2002 |

* cited by examiner

*Primary Examiner* — M. McMahon
(74) *Attorney, Agent, or Firm* — Collard & Roe, P.C.

(57) ABSTRACT

A multi-part piston for an internal combustion engine has an upper piston part with a piston crown, and a lower piston part, each of the piston parts having an inner and an outer support element that delimit an outer circumferential cooling channel and an inner cooling chamber. The cooling chamber bottom has an opening. A holding element is disposed in the inner cooling chamber and extends from the underside of the piston crown vertically toward the opening. The holding element carries a closure element that closes the opening and has at least one cooling oil opening.

8 Claims, 4 Drawing Sheets

MULTI-PART PISTON FOR AN INTERNAL COMBUSTION ENGINE

CROSS REFERENCE TO RELATED APPLICATIONS

This is a divisional of U.S. patent application Ser. No. 12/381,838, filed on Mar. 17, 2009, which claims priority under 35 U.S.C. §119 of German Application No. 10 2008 055 909.1 filed Nov. 5, 2008.

BACKGROUND OF THE INVENTION

1. Field of the Invention

The invention relates to a multi-part piston for an internal combustion engine, having an upper piston part that has a piston crown, and a lower piston part. Each of the piston parts has an inner and an outer support element, which elements delimit an outer circumferential cooling channel and an inner cooling chamber, whose cooling chamber bottom has an opening.

2. The Prior Art

A piston of this type is disclosed in European Patent No. EP 1 222 364 B1. The opening in the cooling chamber bottom allows cooling oil to flow away out of the inner cooling chamber in the direction of the piston crown, in order to achieve a cooling effect as a consequence of the oil passage from the outer circumferential cooling channel to the inner cooling chamber, and to lubricate the piston pin. In order to achieve this goal, the opening in the cooling chamber bottom cannot be too large, because then, the cooling oil would no longer flow away in a metered manner, and its cooling effect in the inner cooling chamber would at least be reduced. This means that the cooling chamber bottom is configured essentially as a relatively wide and thin circumferential ring land that extends approximately in the radial direction, in the upper region of the lower piston part. However, such a structure is difficult to produce. In the case of a forged lower piston part, in particular, there is the additional problem that the microstructure of the material is changed in the region of the ring land, as the result of forging, and this results in an increase in stress in the material structure.

SUMMARY OF THE INVENTION

It is therefore an object of the invention to provide a piston of the stated type, in such a manner that good cooling of the cooling oil in the interior of the cooling chamber and effective lubrication of the piston pin are guaranteed, and, at the same time, the stability of the lower piston part is not impaired.

This object is achieved according to the invention with a multi-part piston for an internal combustion engine, having an upper piston part that has a piston crown, and a lower piston part. The upper piston part and the lower piston part each have an inner and an outer support element, which elements delimit an outer circumferential cooling channel and an inner cooling chamber, whose cooling chamber bottom has an opening. A holding element that extends from the underside of the piston crown vertically toward the opening is provided in the inner cooling chamber, which holding element carries a closure element that closes the opening and has at least one cooling oil opening.

The configuration according to the invention makes it possible to provide a very large opening in the cooling chamber bottom, so that the relatively wide and thin circumferential ring land, which extends approximately in the radial direction, is eliminated. Instead, the opening is closed off with a closure element that is fixed in place by way of a holding element that is connected with the underside of the piston crown. As a result, the stability of the lower piston part is maintained even if it is a forged part. The inner cooling chamber is configured as a circumferential inner cooling channel as the result of the introduction of the holding element, so that the cooling oil is distributed more uniformly and its cooling effect is therefore improved. The at least one cooling oil opening in the closure element provided according to the invention also allows significantly better and more precise metering of the cooling oil that flows away in the direction of the piston pin.

The closure element preferably has two or more cooling openings, so that a very precisely metered amount of cooling oil can flow away out of the inner cooling chamber, in the direction of the piston crown.

The opening in the cooling chamber bottom and the closure element are generally configured to be essentially round. If the opening in the cooling chamber bottom is configured to be oval or an oblong hole, it is practical if the closure element has a shape that corresponds to this, in order to completely cover the opening.

A preferred embodiment provides that the holding element is formed onto the underside of the piston crown, in one piece. As an alternative to this, however, the holding element can also be configured as a separate component and can be held on the underside of the piston crown. The selection is at the discretion of the person skilled in the art, and allows flexible adaptation of the piston properties to the requirements in each operation.

If the holding element is configured as a separate component, it can be provided with a conical depression, for example. The underside of the piston crown then has a conical elevation that corresponds to this. The holding element is held between the underside of the piston crown and the closure element, with force fit, i.e. in clamped manner, whereby the depression and the elevation engage into one another. This method of construction is particularly easy to implement.

However, the separate holding element can also have a journal, for example, which is accommodated in a corresponding dead-end hole on the underside of the piston crown. The shape-fit connection of piston crown and holding element brings about a particularly good seat of the holding element, and therefore particularly great stability of the piston according to the invention.

Independent of how the holding element is attached to the underside of the piston crown, the end of the holding element that faces the opening can have a circumferential contact shoulder that lies on the closure element. The shoulder surrounds a projection that engages into a recess provided in the closure element. Another possibility of attaching the holding element to the closure element consists, for example, in the fact that the end of the holding element that faces the opening has a circumferential groove, into which the closure element engages. Here, too, the shape-fit connection of holding element and closure element offers a particularly reliable, stable hold.

It is practical if the length of the holding element is dimensioned so that the closure element supports itself on the cooling chamber bottom under resilient bias, and thus no longer has any lateral play. The holding element is thereby fixed in place in a particularly firm manner, above the opening in the cooling chamber bottom.

In another preferred embodiment of the piston according to the invention, the holding element is configured as a screw or threaded pin, and the underside of the piston crown has a threaded dead-end hole that corresponds to this, in which the holding element is accommodated. The effect of force on the closure element can therefore take place also on its underside. It is practical if the end of the holding element that faces the opening has a circumferential or interrupted flange that engages underneath the closure element.

Preferably, the opening is provided with a circumferential holding collar that is directed radially inward, and the closure element engages underneath the holding collar with its outer edge. This embodiment has the advantage that it can be assembled even after the upper piston part and lower piston part have been connected.

The closure element can be made from any desired material. In particular, a spring steel sheet has proven to be well suited. The upper piston part and/or the lower piston part can be cast parts or forged parts, and can be produced, for example, from a steel material, particularly forged steel. Friction welding is a possibility for the joining method.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF THE PREFERRED EMBODIMENT

Figure 1:
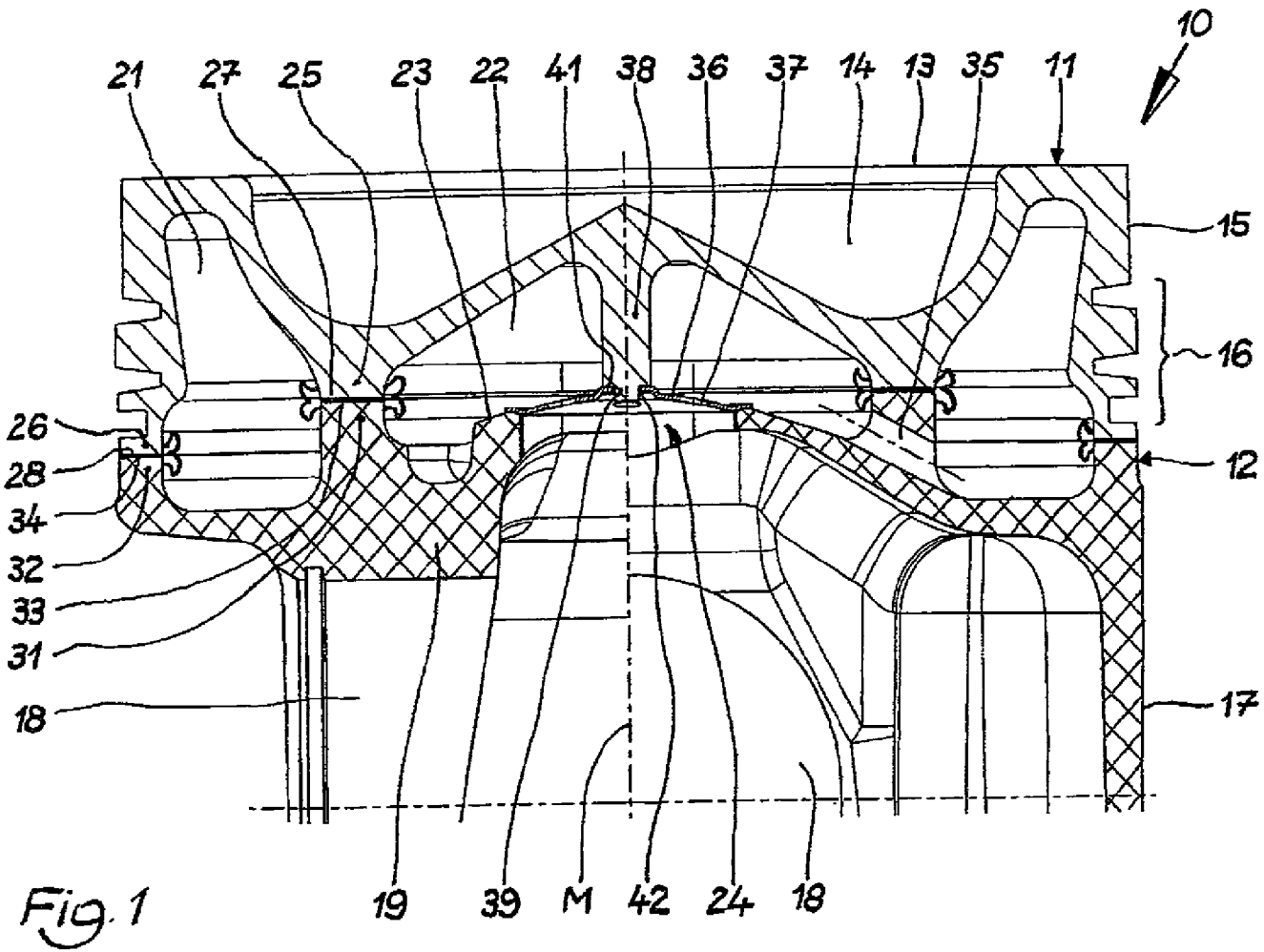
FIG. 1 shows a section through a first embodiment of a piston according to the invention, whereby the right half of the figure has been rotated by 90° relative to the left half.

Referring now in detail to the drawings and, in particular, FIG. 1 shows a first embodiment of a piston 10 according to the invention, which is forged from a steel material in this embodiment. Piston 10 according to the invention is composed of an upper piston part 11 and a lower piston part 12. Upper piston part 11 has a piston crown 13 having a combustion bowl 14, a circumferential top land 15, and a circumferential ring belt 16. Lower piston part 12 has a piston skirt 17, pin bores 18 for accommodating a piston pin, and pin bosses 19. Upper piston part 11 and the lower piston part 12 form a circumferential outer cooling channel 21 and a central inner cooling chamber 22. Cooling chamber bottom 23 of cooling chamber 22 is provided with a relatively large opening 24.

Upper piston part 11 has an inner support element 25 and an outer support element 26. Inner support element 25 is disposed on the underside of upper piston part 11, circumferentially, in ring shape, and has a joining surface 27. Inner support element 25 furthermore forms part of the circumferential wall of the inner cooling chamber 22. Outer support element 26 of the upper piston part 11 is formed below ring belt 16, and has a joining surface 28.

Lower piston part 12 also has an inner support element 31 and an outer support element 32. Inner support element 31 is disposed on the top of lower piston part 12, circumferentially, and has a joining surface 33. Inner support element 31 furthermore forms part of the circumferential wall of inner cooling chamber 22. Outer support element 32 is formed as an extension of piston skirt 17 in the embodiment shown, and has a joining surface 34. One or more cooling oil channels 35 are provided in inner support element 31, and connect cooling channel 21 with cooling chamber 22. Cooling oil channel 35 runs at an angle upward, proceeding from cooling channel 21, in the direction of cooling chamber 22.

Upper piston part 11 and lower piston part 12 were joined, in the embodiment shown, in known manner, by means of friction welding along joining surfaces 27, 28 and 33, 34, respectively.

Opening 24 in cooling chamber bottom 23 is closed off with a closure element 36. In the embodiment shown, closure element 36 is produced from a spring sheet metal, approximately 0.8 mm thick, and has multiple cooling oil openings 37, which allow the cooling oil to flow away from inner cooling chamber 22 in the direction of the piston crown during operation.

A holding element 38, which has approximately the shape of a journal in the embodiment shown, is formed on in one piece on the underside of piston crown 13, and projects into center axis M of piston 10, vertically, in the direction of opening 24. At its free end, holding element 38 has a projection 39 that is surrounded by a circumferential contact shoulder 41. Projection 39 passes through a central recess 42 provided in closure element 36, whereby contact shoulder 41 lies on the top of closure element 36. The length of holding element 38 is dimensioned in such a manner in this embodiment, that closure element 36 supports itself on cooling chamber bottom 23 under spring bias. Closure element 36 is therefore held securely and without play.

Figure 2:
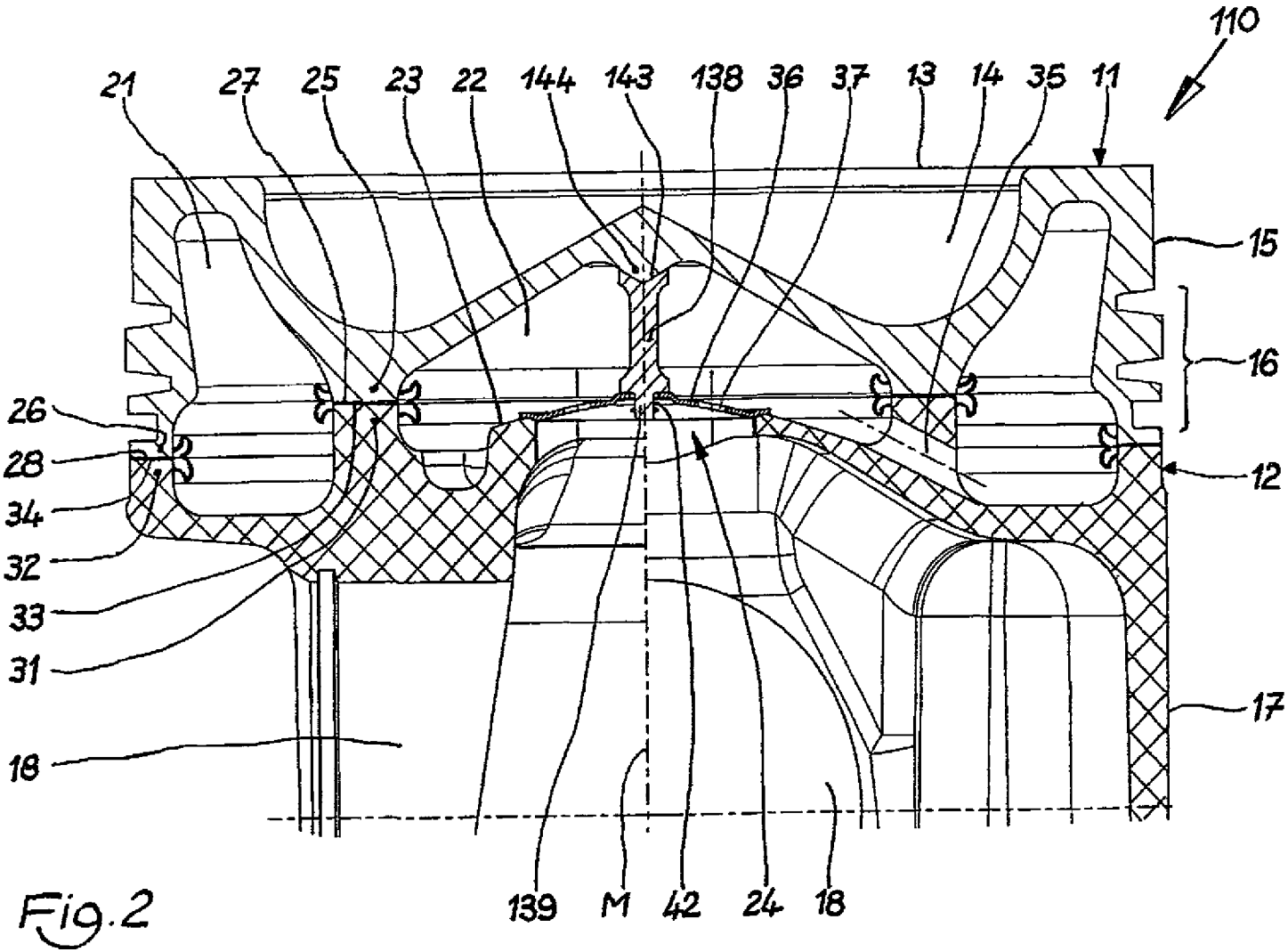
FIG. 2 shows a section through another embodiment of a piston according to the invention, whereby the right half of the figure has been rotated by 90° relative to the left half.

FIG. 2 shows a second embodiment of a piston 110 according to the invention. Piston 110 has essentially the same construction as piston 10 according to FIG. 1, so that the same structures are provided with the same reference symbols, and with regard to these reference symbols, reference is made to the description of FIG. 1.

A significant difference as compared with piston 10 according to FIG. 1 consists in the fact that in piston 110, the holding element 138 is present as a separate component. In the embodiment shown, holding element 138 is provided with a conical depression 143 at its end that faces piston crown 13. The underside of piston crown 13 has a corresponding conical elevation 144. Holding element 138 has a projection 139 at its end that faces closure element 36, which projection is surrounded by a circumferential contact shoulder 141. Projection 139 passes through a central recess 42 provided in closure element 36, whereby contact shoulder 141 lies on the top of closure element 36. The length of holding element 138 is dimensioned in such a way, in the embodiment shown, that closure element 36 supports itself on cooling chamber bottom 23 under resilient bias, and the conical depression 143 and conical elevation 144 engage into one another. Closure element 36 is therefore held securely and without play.

Figure 3:
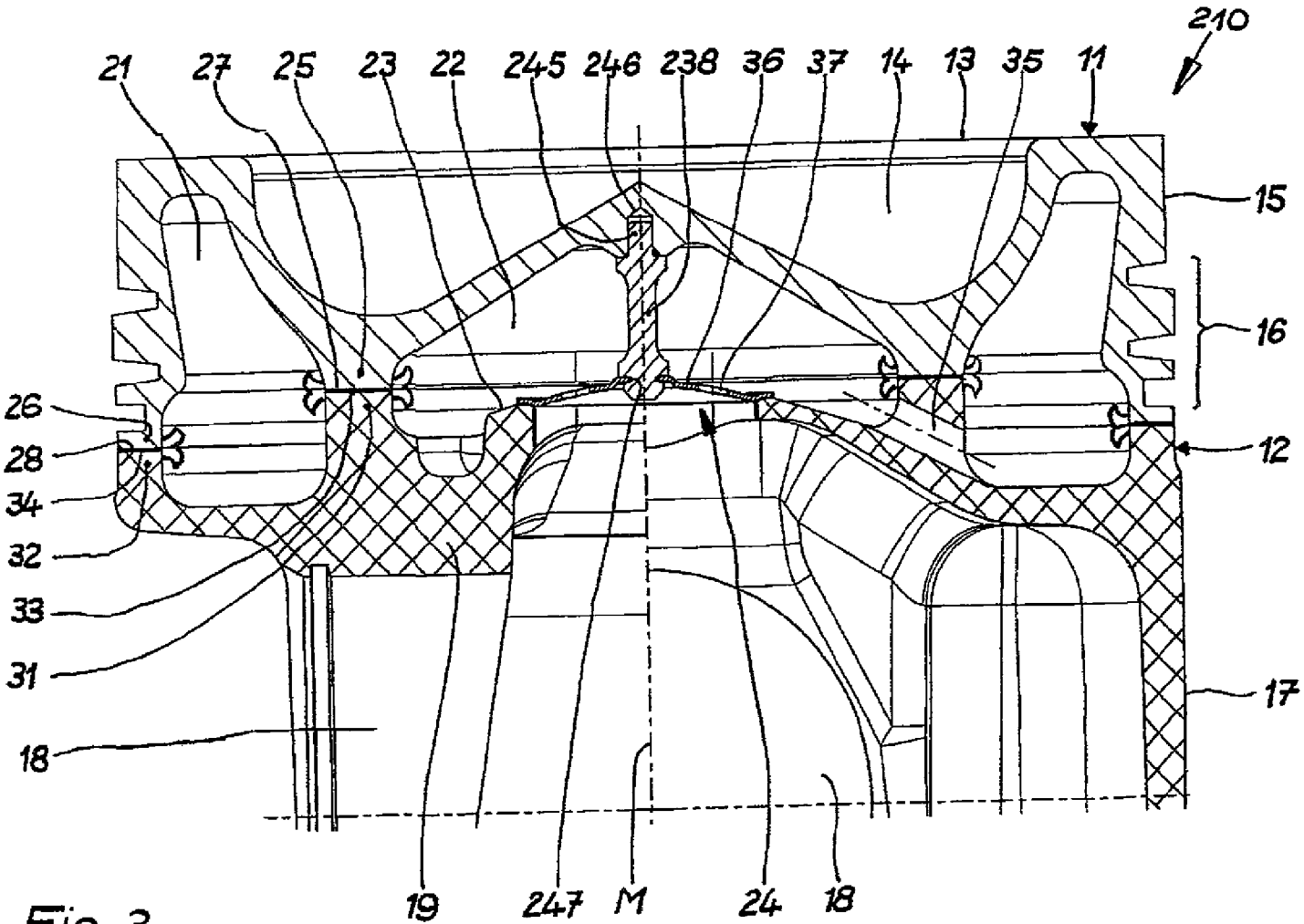
FIG. 3 shows a section through another embodiment of a piston according to the invention, whereby the right half of the figure has been rotated by 90° relative to the left half.

FIG. 3 shows a third embodiment of a piston 210 according to the invention. Piston 210 has essentially the same construction as piston 10 according to FIG. 1, so that the same structures are provided with the same reference symbols, and with regard to these reference symbols, reference is made to the description of FIG. 1.

In the case of piston 210, as well, holding element 238 is configured as a separate component. In contrast to piston 110 according to FIG. 2, holding element 238 has a journal 245 at its end that faces piston crown 13. The underside of piston crown 13 is provided with a corresponding dead-end hole 246, in which journal 245 is accommodated. Holding element 238 has a circumferential groove 247 at its end that faces closure element 36, in which groove closure element 36 is held by snapping it in. The length of holding element 238 is dimensioned in such a way, in the embodiment shown, that closure element 36 supports itself on cooling chamber bottom 23 under resilient bias. Closure element 36 is therefore held securely and without play.

Of course, closure element 36 in these embodiments can also consist of a non-resilient, preferably metallic material, and be held on cooling chamber bottom 23 with a clamping action, i.e. with force fit.

For assembly of these embodiments, holding element 138, 238, as applicable, is attached to upper piston part 11, and then closure element 36 is attached to holding element 38, 138, 238. After upper piston part 11 and lower piston part 12 have been connected, closure element 36 lies firmly on the cooling chamber bottom.

Figure 4:
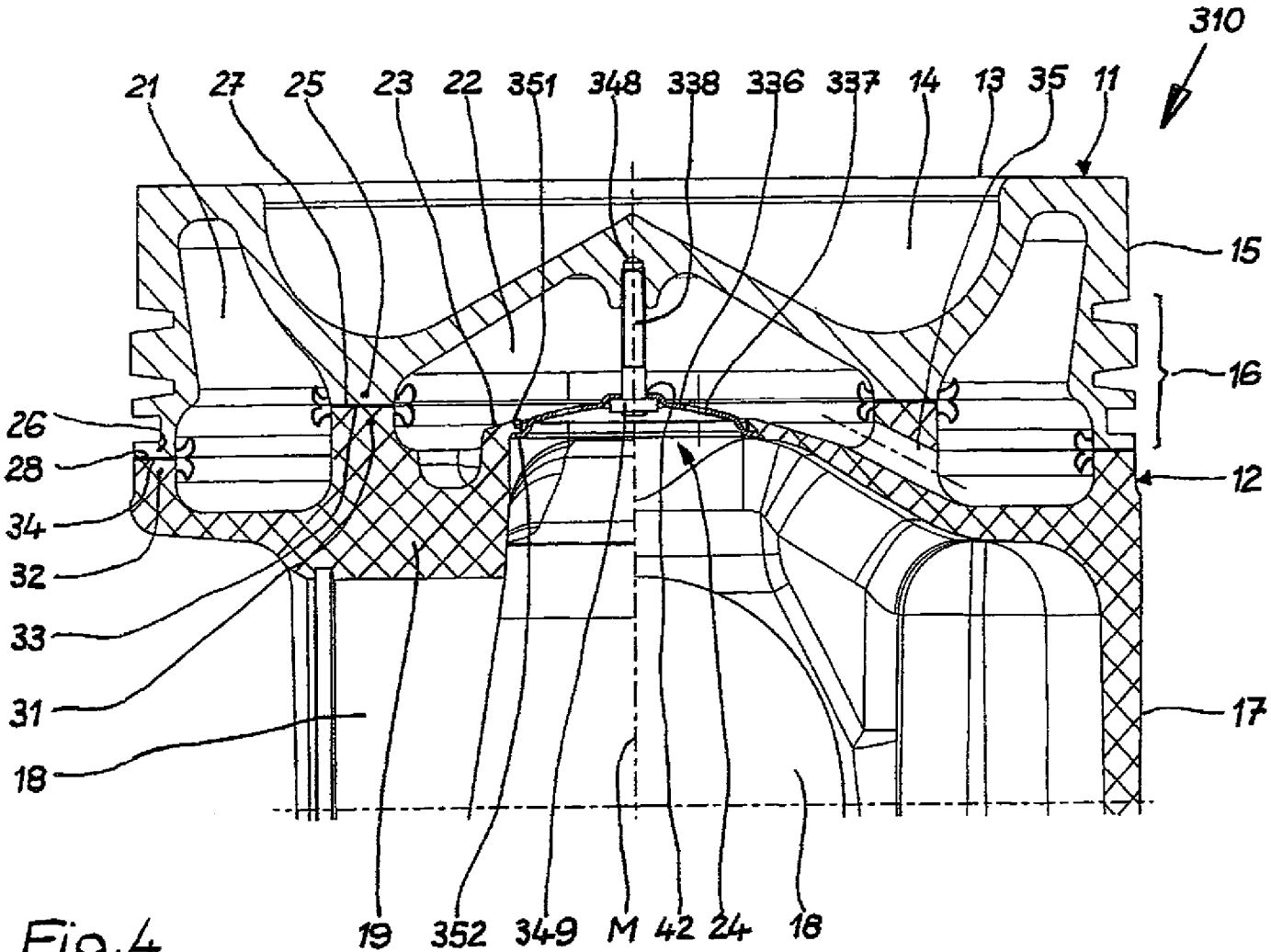
FIG. 4 shows a section through another embodiment of a piston according to the invention, whereby the right half of the figure has been rotated by 90° relative to the left half.

FIG. 4 shows a fourth embodiment of a piston 310 according to the invention. Piston 310 has essentially the same construction as piston 10 according to FIG. 1, so that the same structures are provided with the same reference symbols, and with regard to these reference symbols, reference is made to the description of FIG. 1.

The significant difference as compared with all the embodiments described until now consists in the fact that in the embodiment of FIG. 4, holding element 338 is configured as a threaded pin. In place of a threaded pin, of course, a screw can also be used. The underside of piston 13 is provided with a corresponding threaded dead-end hole 348, into which holding element 338 is screwed. The end of holding element 338 that faces opening 24 has a circumferential or interrupted flange 349 (in the case of a screw: a screw head). Holding element 338 passes through the central bore provided in the closure element, from the underside of closure element 36 that faces the piston pin. Thus, closure element 36 is not on cooling chamber bottom 23, but rather on the underside of cooling chamber bottom 23, with force fit, if applicable under resilient bias. For this purpose, the edge of opening 24 is provided, in the embodiment shown, with a circumferential holding collar 351 that is directed radially inward, on which collar closure element 36 lies with its outer edge 352 and engages underneath the holding collar 351.

Accordingly, while only a few embodiments of the present invention have been shown and described, it is obvious that many changes and modifications may be made thereunto without departing from the spirit and scope of the invention.

What is claimed is:

1. A multi-part piston for an internal combustion engine, comprising:

an upper piston part that has a piston crown, an inner support element and an outer support element;

a lower piston part having an inner support element and an outer support element, said inner and outer support elements on the upper and lower piston parts delimiting an outer circumferential cooling channel and an inner cooling chamber having an opening in a bottom thereof;

a closure element that closes the opening, said closure element having at least one cooling oil opening; and a holding element integrally formed with an underside of the piston crown and extending vertically toward the opening, said holding element being disposed in the inner cooling chamber and said holding element butting the closure element;

wherein an end of the holding element that faces the opening has a circumferential groove, into which the closure element engages, and wherein a length of the holding element is dimensioned so that the closure element supports itself on the bottom of the cooling chamber under resilient bias.

2. The piston according to claim 1, wherein the closure element has two or more cooling oil openings.

3. The piston according to claim 1, wherein the opening in the bottom of the cooling chamber and the closure element are configured to be essentially round.

4. The piston according to claim 1, wherein the opening in the bottom of the cooling chamber is configured to be oval or as an oblong hole, and the closure element is configured to correspond to a shape of the opening.

5. The piston according to claim 1, wherein the closure element is produced from a spring steel material.

6. The piston according to claim 1, wherein at least one of the upper piston part and the lower piston part are forged parts.

7. The piston according to claim 1, wherein at least one of the upper piston part and the lower piston part are produced from a steel material.

8. The piston according to claim 1, wherein the upper piston part and the lower piston part are connected with one another by means of friction welding.

* * * * *